US006773292B2

(12) United States Patent
Fawcett

(10) Patent No.: US 6,773,292 B2
(45) Date of Patent: Aug. 10, 2004

(54) CONNECTOR

(75) Inventor: Michael J. Fawcett, Bury (GB)

(73) Assignee: Rota Engineering Limited, Manchester (GB)

( * ) Notice: Subject to any disclaimer, the term of this patent is extended or adjusted under 35 U.S.C. 154(b) by 0 days.

(21) Appl. No.: 10/472,030

(22) PCT Filed: Mar. 7, 2002

(86) PCT No.: PCT/GB02/01008

§ 371 (c)(1),
(2), (4) Date: Jan. 27, 2004

(87) PCT Pub. No.: WO02/075858

PCT Pub. Date: Sep. 26, 2002

(65) Prior Publication Data

US 2004/0121641 A1 Jun. 24, 2004

(30) Foreign Application Priority Data

Mar. 16, 2001 (GB) ..... 0106708

(51) Int. Cl.[7] ..... H01R 4/50
(52) U.S. Cl. ..... 439/348
(58) Field of Search ..... 439/348, 349, 439/258

(56) References Cited

U.S. PATENT DOCUMENTS 3,165,340 A 1/1965 Kuehl et al.
3,319,213 A * 5/1967 Roland ..... 439/348
3,422,390 A * 1/1969 Tucker ..... 439/348
3,509,515 A 4/1970 Acord
3,888,559 A * 6/1975 Geib ..... 439/348
5,984,709 A 11/1999 Zink et al.
6,062,891 A * 5/2000 Villiers ..... 439/348

FOREIGN PATENT DOCUMENTS

DE dex 7/1999

* cited by examiner

*Primary Examiner*—Tho D. Ta
(74) *Attorney, Agent, or Firm*—Akin Gump Strauss Hauer & Feld LLP

(57) ABSTRACT

A connector comprising first and second interengagable connector elements, the first comprising a socket and the second comprising a spigot insertable into the socket of the first element, wherein the first element supports at least one radially displaceable locking member protruding into the socket and a displaceable collar for controlling the radial position of the or each locking member. The second element defines at least one groove extending from adjacent an end of the spigot and aligned to receive the or a respective locking member projecting into the socket. The collar is displaceable relative to the first element between a first position in which the or at least one locking member is caused to project at least a first distance into the socket and a second position in which the or at least one locking member is caused to project at least a second distance in the socket, the first distance being greater than the second. The or each groove has a first relatively shallow portion extending from adjacent the end of the spigot and a second relatively deep portion remote from the end of the spigot, the first relatively shallow groove portion being dimensioned to accommodate a locking member projecting the second but not the first distance into the socket, and the second relatively deep groove portion being dimensioned to accommodate a locking member projecting the first distance into the socket.

6 Claims, 4 Drawing Sheets

CONNECTOR

The present invention relates to a connector and more particularly to a connector which has two components that can be interconnected only when the components are correctly aligned.

Many electrical applications require that prior to connection of male and female connector portions the portions are correctly aligned. In some cases this alignment is achieved simply by the arrangement of the electrical pins. There are also many applications where it is important that once connected, the risks of accidental disconnection are minimised.

In a known connector the necessary alignment is achieved by the provision of a pin on the body of one connector component and a groove in the body of a second connector component whereby connection can only take place when the pin and the slot are correctly aligned. Once connection has been achieved, the connectors are locked together by the interengagement of one or more retractable locking members on one component with a groove on the other component.

The known connector has the disadvantage that it is difficult to provide the pin in a robust yet economical manner and in heavy industrial environments there is a risk that the pin may break off with the result that attempts may be made to interengage the connector components in a misaligned condition.

The present invention seeks to obviate or mitigate some or all of the problems outlined above.

According to the present invention there is provided a connector comprising first and second interengagable connector elements, the first comprising a socket and the second comprising a spigot insertable into the socket of the first element, wherein the first element supports at least one radially displaceable locking member protruding into the socket and a displaceable collar for controlling the radial position of the or each locking member, the second element defines at least one groove extending from adjacent an end of the spigot and aligned to receive the or a respective locking member projecting into the socket, the collar is displaceable relative to the first element between a first position in which the or at least one locking member is caused to project at least a first distance into the socket and a second position in which the or at least one locking member is caused to project at least a second distance in the socket, the first distance being greater than the second, and the or each groove has a first relatively shallow portion extending from adjacent the end of the spigot and a second relatively deep portion remote from the end of the spigot, the first relatively shallow groove portion being dimensioned to accommodate a locking member projecting the second but not the first distance into the socket, and the second relatively deep groove portion being dimensioned to accommodate a locking member projecting the first distance into the socket.

Preferably, the number of grooves defined by the second element is equal to the number of locking members provided on the first element and most preferably a plurality of locking members are offset unequally about the first element and a plurality of grooves are defined in similarly offset positions on the second element. Each locking member may be a ball. Biasing means may be provided to bias the collar towards the first position.

Suitably, three locking members may be provided on the first element and three grooves may be defined by the second element An embodiment of the present invention will now be described, by way of example, with reference to the accompanying drawings, in which.

Figure 1:
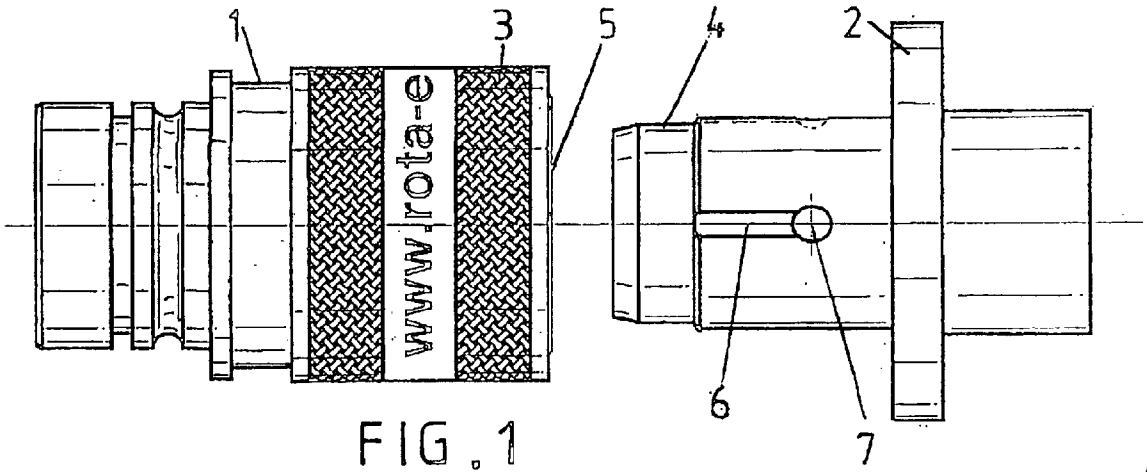
FIG. 1 is an outline illustration of two components of a connector arrangement in accordance with the present invention.

Referring to FIG. 1, the assembly comprises a female connector, 1 which is interengagable with a male connector, 2, the female connector 1 having a retractable collar 3. The male connector 2 has a spigot 4 for insertion into a socket 5 of the female connector 1. The male connector has three axial grooves about its circumference, only one of which is visible in the view of FIG. 1. The axial grooves define relatively shallow portions 6 extending from adjacent the spigot end and relatively deep end portions 7 which form ball seats.

Figure 2:
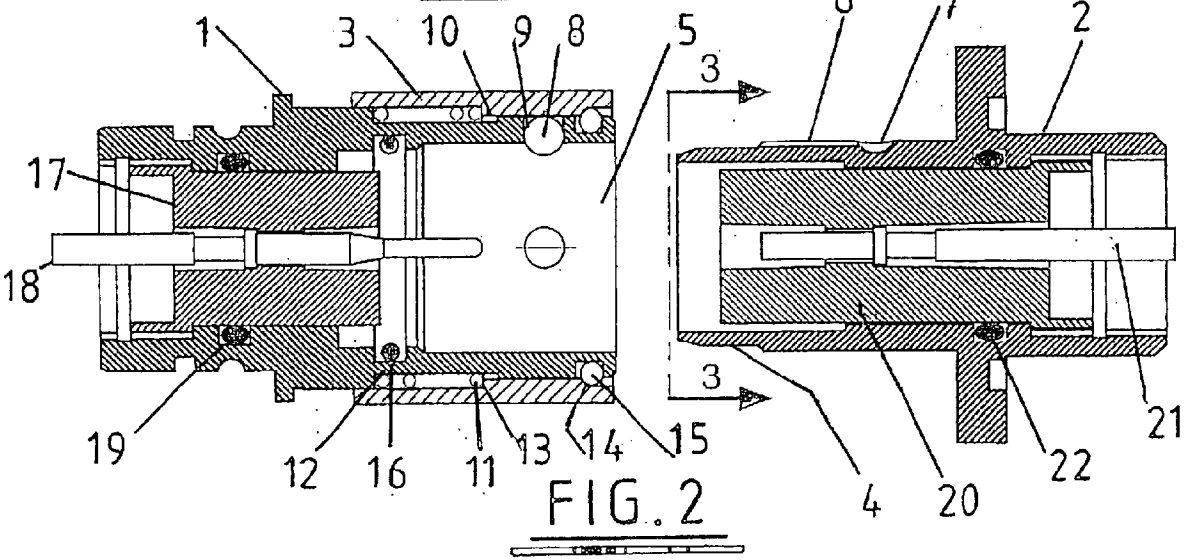
FIG. 2 is an illustration of the connector components of FIG. 1 in axial section.

FIG. 2 shows the arrangement in more detail. The female connector, 1, defining the a socket 5 supports three lock balls 8, set about its circumference, only one of which is visible in the view of FIG. 2. Each lock ball 8 is located within an aperture 9 opening into socket 5. The apertures are shaped to prevent removal of the ball from the socket in a radially inwards direction.

The retractable collar 3 has two positions, that is a first or engaged position as in FIG. 2 and a second or retracted position as shown in FIGS. 5 to 8. In the engaged position a radially inwardly projecting rib 10 of the collar 3 displaces the lock balls 8 in the radially inwards direction, restricting their freedom of movement and causing the balls to project by a first relatively large distance into the socket 5. On retraction of the collar 3, the inwardly projecting rib 10 is not radially aligned with the lock balls 8 thereby allowing the lock balls 8 to move in a radially outwards direction and allowing the balls to be pushed back into the apertures 9 so that the balls project by a second relatively small distance into socket 5. This action is shown in subsequent figures.

The collar is biased towards the engaged position by a spring 11. The spring 11 is held between a lip 12 on a body of the female connector and a first lip 13 on collar 3. When the collar 3 is in the engaged position a second lip 14 of the collar 3 is biased against a spring clip 15 which is of a diameter suitable to prevent the collar 3 being removed from the body of the female connector 1.

An O-ring seal 16 is provided within socket 5. The female connector 1 comprises also an electrical contact component comprising a body 17 supporting male connector pins 18, only one of which is shown in FIG. 2. An O-ring seal 19 is provided between the electrical contact component body 17 and the body of the female connector, 1.

The male connector 2 comprises an electrical contact component comprising a body 20 supporting female connector pin-sockets 21. An O-ring seal 22 is provided between the body of the male connector 2 and the body 20.

Figure 3:
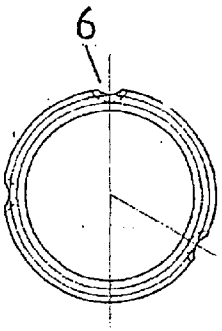
FIG. 3 is an end view on line 3-3 of a spigot defined by a component shown in FIG. 2.

FIG. 3 shows that three axial grooves 6 are provided about the body of the spigot 4. These are offset unequally such that by unequally offsetting the lockballs 8 about the socket 5 in respective positions, the spigot and socket can interengage only in a predetermined orientation.

Figure 4:
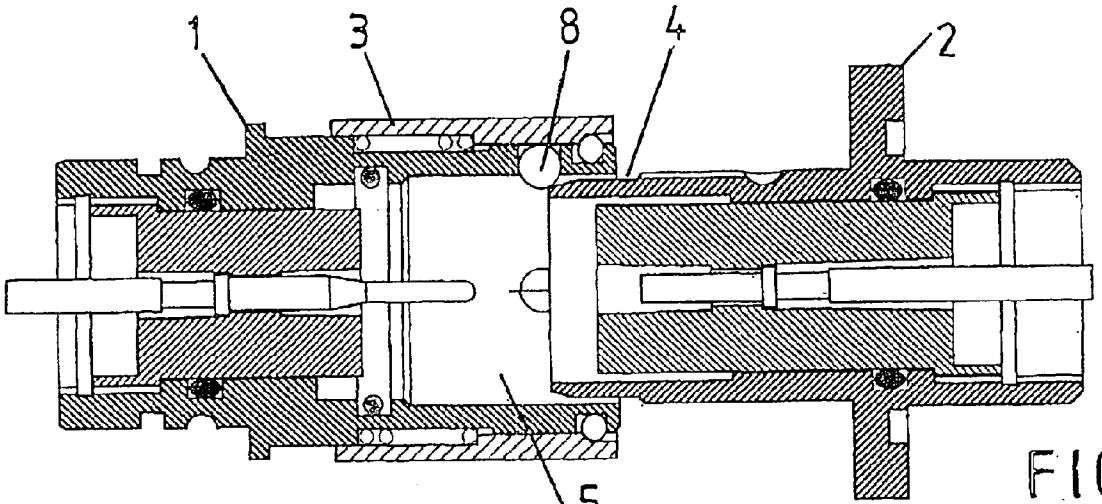
FIGS. 4 to 9 are illustrations of the connector of FIG. 1 in axial section as the connector components are progressively engaged.

FIG. 4 shows the collar 3 in an engaged position in which it displaces the lock balls 8 radially inwards such that the spigot 4 of male connector 2 and the socket 5 of female connector 1 cannot engage each other due to the radially inwards projection of the lock balls 8.

Figure 5:
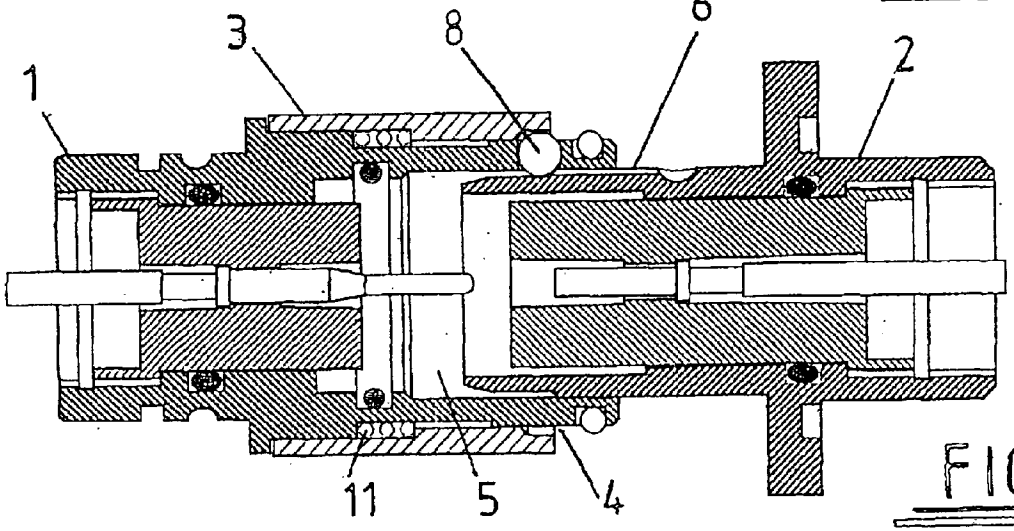

Referring to FIG. 5, on retraction of the collar 3 by exerting pressure against biasing means 11, the lock balls 8 are given radial freedom of movement by the collar 3 such that the spigot 4 may push the lock balls 8 radially outwards . However, the clearance provided by the lock balls 8 is only sufficient to allow the spigot 4 to engage the socket 5 to the extent shown in FIG. 5 unless the lock balls 8 are aligned with an axial groove 6.

Figure 6:
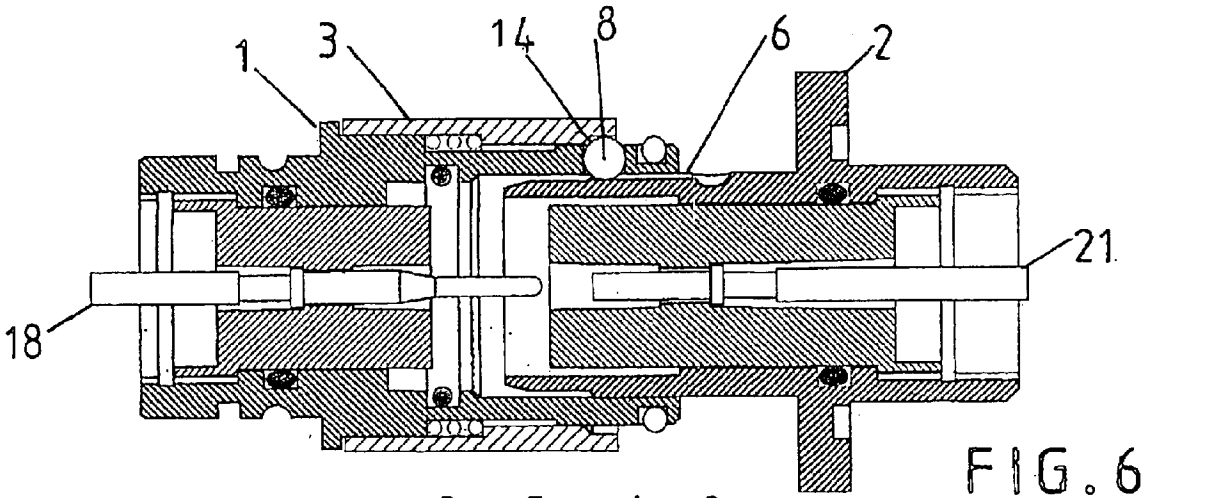

Referring to FIG. 6, the arrangement is shown where each axial groove 6 is aligned with a lock ball 8, whereby further engagement of the connector elements can occur. This alignment ensures that male connector pins 21 are correctly aligned with female connector pin sockets 18 before the male connector 2 is fully mated with female connector 1. Once partially engaged, the collar 3 is prevented from returning to an engaged position as the second lip 14 of collar 3 is unable to pass over the lock balls 8 in their radially outwardly displaced positions. The lock balls 8 cannot be displaced radially inwards by the collar given that the balls 8 are in the relatively shallow part 6 of the spigot grooves.

Figure 7:
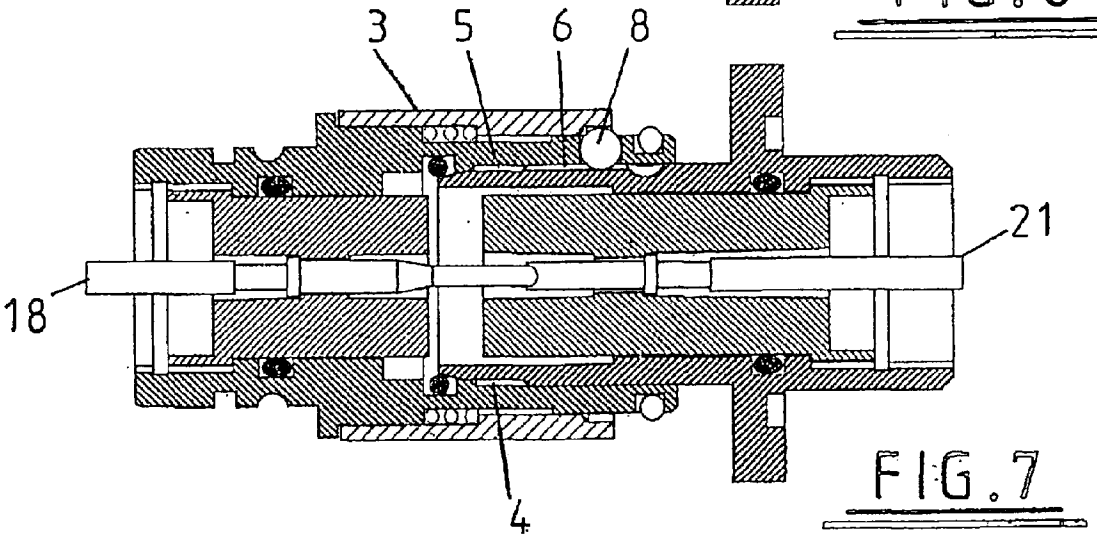

FIG. 7 shows that continued engagement of the spigot 4 into socket 5 causes male connector pins 18 to meet and engage female connector pin-sockets 21. As this occurs, the lock balls 8 are still pushed radially outwards by the groove 6, preventing return of the collar 3 to the engaged position as described above.

Figure 8:
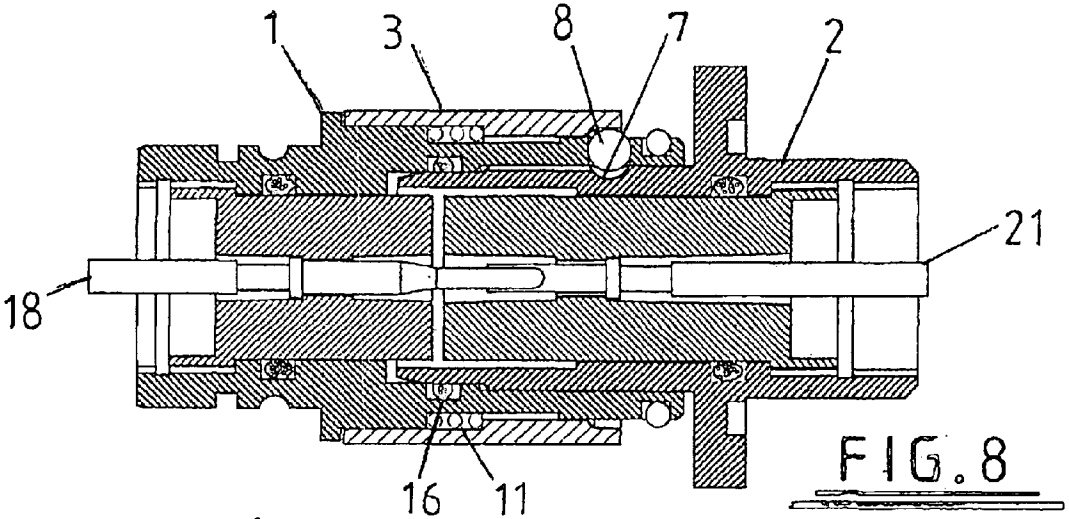
Figure 9:
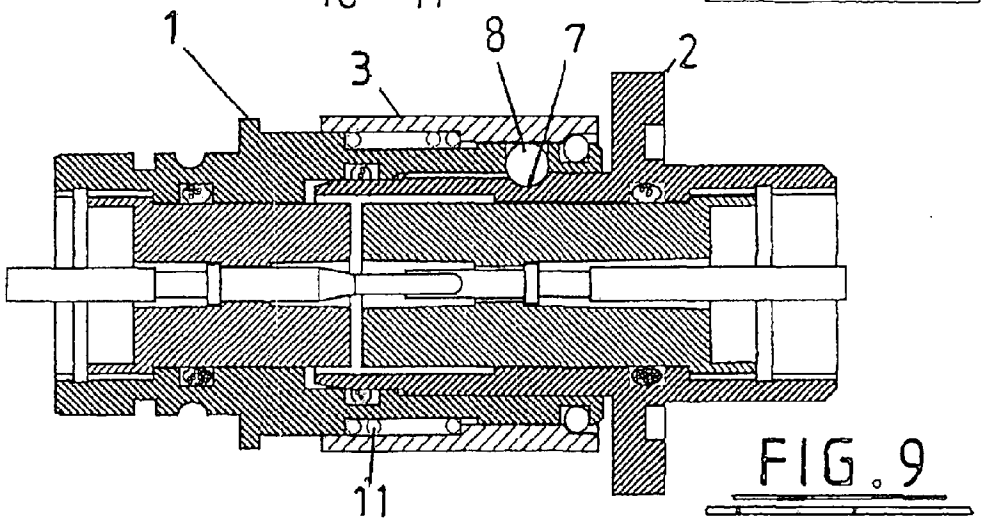

Referring to FIGS. 8 and 9, these show the state of fill engagement of the female connector 1 and male connector 2. Connector pins 18 are fully mated with connector pin-sockets 21 and O-ring seal 16 is compressed to seal the connection.

In FIG. 8 the collar 3 is shown as if held in a retracted position against the action of the spring 11. Lock balls 8 are now aligned with ball seats 7, and the lock balls 8 therefore once again have freedom of movement in the radially inwards direction.

Referring to FIG. 9, on release of the collar 3, the collar is biased towards to the engaged position by the spring 11, pushing the lock balls 8 radially inwards into ball seats 7. Lock balls 8 once again have no radial freedom of movement, as they are pushed radially inwards by the collar 3, thus locking the male connector 2 to the female connector 1. It is not possible to pull the connectors apart once locked, without retraction of collar 3.

Retraction of collar 3 will once more give the lock balls 8 radial freedom of movement. If tension is applied between the two halves of the connector following the retraction of the collar 3, the male connector 2 and female connector 1 may disengage. The sequence of events is the reverse of that described above.

Although three lock balls and three grooves are shown in the illustrated embodiments it will be appreciated that other numbers of lock balls and grooves may be provided. For example the provision of one lock ball and one groove may ease manufacture, particularly for connectors of smaller diameter.

What is claimed is:

1. A connector comprising first and second interengagable connector elements, the first comprising a socket and the second comprising a spigot insertable into the socket of the first element, wherein the first element supports at least one radially displaceable locking member protruding into the socket and a displaceable collar for controlling the radial position of the or each locking member, the second element defines at least one groove extending from adjacent an end of the spigot and aligned to receive the or a respective locking member projecting into the socket, the collar is displaceable relative to the first element between a first position in which the or at least one locking member is caused to project at least a first distance into the socket and a second position in which the or at least one locking member is caused to project at least a second distance in the socket, the first distance being greater than the second, and the or each groove has a first relatively shallow portion extending from adjacent the end of the spigot and a second relatively deep portion remote from the end of the spigot, the first relatively shallow groove portionbeing dimensioned to accommodate a locking member projecting the second but not the first distance into the socket, and the second relatively deep groove portion being dimensioned to accommodate a locking member projecting the first distance into the socket.

2. A connector according to claim 1, wherein a plurality of locking members are offset unequally about the first element and a plurality of grooves are defined in similarly offset positions on the second element.

3. A connector according to claim 1, wherein each locking member is a ball.

4. A connector according to claim 1, wherein means are provided to bias the collar towards the first position.

5. A connector according to claim 1, wherein the number of grooves defined by the second element is equal to the number of locking members provided on the first element.

6. A connector according to claim 5, wherein three locking members are provided on the first element and three grooves are defined by the second element.

* * * * *